US011098857B2

(12) United States Patent
Li et al.

(10) Patent No.: US 11,098,857 B2
(45) Date of Patent: Aug. 24, 2021

(54) LED TUBE LAMP

(71) Applicant: XIAMEN ECO LIGHTING CO. LTD., Xiamen (CN)

(72) Inventors: Guochao Li, Xiamen (CN); Qi Liu, Xiamen (CN); Shaokun Guo, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 5 days.

(21) Appl. No.: 16/404,689

(22) Filed: May 6, 2019

(65) Prior Publication Data

US 2020/0200334 A1 Jun. 25, 2020

(30) Foreign Application Priority Data

Dec. 20, 2018 (CN) ..... 201822150427.6

(51) Int. Cl.

| | |
|---|---|
| ***F21K 9/66*** | (2016.01) |
| ***F21V 3/10*** | (2018.01) |
| ***F21K 9/278*** | (2016.01) |
| ***F21V 29/506*** | (2015.01) |
| ***F21V 29/87*** | (2015.01) |
| ***F21Y 115/10*** | (2016.01) |
| ***F21Y 103/10*** | (2016.01) |

(52) U.S. Cl.

CPC ..... *F21K 9/66* (2016.08); *F21K 9/278* (2016.08); *F21V 3/10* (2018.02); *F21V 29/506* (2015.01); *F21V 29/87* (2015.01); *F21Y 2103/10* (2016.08); *F21Y 2115/10* (2016.08)

(58) Field of Classification Search

CPC ..... F21K 9/66; F21K 9/278; F21V 29/506; F21V 29/87; F21V 3/10; F21Y 2115/10; F21Y 2103/10

See application file for complete search history.

(56) References Cited

U.S. PATENT DOCUMENTS

| | | | | |
|---|---|---|---|---|
| 3,647,148 | A * | 3/1972 | Wince | F21S 8/02 362/223 |
| 8,733,969 | B2 * | 5/2014 | Bryan | F21S 8/03 362/235 |
| 9,822,934 | B2 * | 11/2017 | Vollkommer | F21K 9/27 |
| 9,945,520 | B2 * | 4/2018 | Jiang | F21V 17/101 |
| 10,317,021 | B2 * | 6/2019 | Magno | F21S 4/20 |
| 2006/0028837 | A1 * | 2/2006 | Mrakovich | G02B 6/001 362/602 |
| 2009/0219713 | A1 * | 9/2009 | Siemiet | F21V 15/013 362/218 |

(Continued)

*Primary Examiner* — Tsion Tumebo

(74) *Attorney, Agent, or Firm* — Chun-Ming Shih; Lanway IPR Services

(57) ABSTRACT

The LED tube lamp includes a lamp tube, an LED substrate, and a diffusion film. The LED substrate includes a plurality of LED chips disposed on the LED substrate, and a driving circuitry for receiving power to enable the plurality of LED chips. The diffusion film is disposed on a surface of the lamp tube. The diffusion film includes a first region and a second region adjacent to the first region. The first region and the second region of the diffusion film are arranged along a longitudinal axis of the lamp tube. The first region has a first transmittance rate and the second region has a second transmittance rate higher than the first transmission rate.

14 Claims, 4 Drawing Sheets

(56) References Cited

U.S. PATENT DOCUMENTS

| | | | | |
|---|---|---|---|---|
| 2010/0053970 | A1* | 3/2010 | Sato | G02B 6/001 362/259 |
| 2010/0220469 | A1* | 9/2010 | Ivey | F21V 29/763 362/218 |
| 2010/0321921 | A1* | 12/2010 | Ivey | F21K 9/64 362/84 |
| 2011/0216523 | A1* | 9/2011 | Tong | F21V 5/002 362/84 |
| 2012/0106144 | A1* | 5/2012 | Chang | F21V 5/00 362/218 |
| 2012/0147597 | A1* | 6/2012 | Farmer | F21V 3/06 362/223 |
| 2013/0033888 | A1* | 2/2013 | Van Der Wel | F21V 7/18 362/555 |
| 2013/0093359 | A1* | 4/2013 | Hsu | F21V 19/003 315/312 |
| 2014/0029246 | A1* | 1/2014 | Umeda | F21K 9/68 362/217.05 |
| 2014/0306599 | A1* | 10/2014 | Edwards | F21V 3/02 313/502 |
| 2016/0109068 | A1* | 4/2016 | Boonekamp | F21K 9/66 362/218 |
| 2016/0270164 | A1* | 9/2016 | Xiong | H05B 45/50 |
| 2017/0089530 | A1* | 3/2017 | Jiang | H05B 45/00 |
| 2017/0102114 | A1* | 4/2017 | Xiong | F21K 9/278 |
| 2018/0335200 | A1* | 11/2018 | Jiang | F21V 29/83 |

* cited by examiner

LED TUBE LAMP

FIELD

The present invention is related to an LED tube lamp, and more particularly related to an LED tube lamp with improved lighting characteristics.

BACKGROUND

The beam angle of a conventional LED tube lamp is about 220 degrees. The beam angle of the LED tube lamp is large, so a portion of the light beam would pass through the lamp tube toward the backside of the light source. As a result, some emitted light beam would not be able to reach the object to be lit, which is a waste of the emitted light beam. The light utilization is inefficient.

SUMMARY OF INVENTION

The present invention intends to provide a LED tube lamp with a small beam angle, and the light utilization of the LED tube lamp is improved.

In order to solve the above technical problems, in some embodiments, the LED tube lamp includes a lamp tube, a LED substrate, and a diffusion film. The LED substrate is disposed inside the LED tube lamp. The LED substrate includes a plurality of LED chips disposed on a forward side of the LED substrate for emitting light, and a driving circuitry for receiving power to enable the plurality of LED chips. The diffusion film is disposed on a surface of the lamp tube. The diffusion film includes a first region and a second region adjacent to the first region. The first region and the second region of the diffusion film are arranged along a longitudinal axis of the lamp tube. The first region has a first transmittance rate and the second region has a second transmittance rate higher than the first transmission rate.

In some embodiments, the first region of the diffusion film is capable of reflecting a significant portion of light emitted from the plurality of LED chips toward the second region of the diffusion film.

In some embodiments, the first region of the diffusion film has a higher thermal conductivity than the second region of the diffusion film.

In some embodiments, the diffusion film is formed by coating a plurality of first particles on the first region, and a plurality of second particles different from the first particles on the second region.

In some embodiments, the first region of the diffusion film is disposed proximal to the forward side of the LED substrate, and the second region of the diffusion film is disposed distal to the forward side of the LED substrate.

In some embodiments, the first region of the diffusion film has a higher thermal conductivity than the second region of the diffusion film. In some embodiments, the first region includes a plurality of light reflection particles coated on the surface of the lamp tube.

In some embodiments, the lamp tube includes a first end section, a body section, and a second end section, wherein the light reflecting particles has a higher density at the first end section and the second end section than at the body section.

In some embodiments, the first region includes a plurality of high thermal conductivity particles coated on the surface of the lamp tube.

In some embodiments, the second region includes transparent or translucent material mixed with light diffusion particles.

In some embodiments, the second region is formed by coating a transparent or translucent material on the surface of the lamp tube.

In some embodiments, the second region includes a plurality of light diffusion particles coated on the surface of the lamp tube.

In some embodiments, the lamp tube includes a first end section, a body section, and a second end section, wherein the light diffusion particles have a higher density at the first end section and the second end section than at the body section.

In some embodiments, the lamp tube includes a first end section, a body section, and a second end section, wherein the second region of the diffusion film is larger at the first end section and at the second end section than at the body section.

In some embodiments, the LED tube lamp includes a lamp tube, an LED substrate. The LED substrate is disposed inside the LED tube lamp, and includes a plurality of LED chips disposed on the LED substrate for emitting light, and also includes a driving circuitry for receiving power to enable the plurality of LED chips. The lamp tube has a first region and a second region adjacent to the first region along a longitudinal axis of the lamp tube. The first region is proximal to the LED substrate, and the second region is distal to the LED substrate. The second region has a higher light transmittance rate than the first region.

In some embodiments, the first region includes a plurality of first optical lenses integrally formed on the surface of the lamp tube.

In some embodiments, the second region is formed by coating a plurality of transparent or translucent particles on the surface of the lamp tube.

In some embodiments, the second region includes a plurality of second optical lenses integrally formed on the surface of the lamp tube.

In some embodiments, the second region includes a plurality of light diffusion particles coated on the surface of the lamp tube.

In some embodiments, the lamp tube includes a first end section, a body section, and a second end section, wherein the light diffusion particles have a higher density at the first end section and the second end section than at the body section.

In some embodiments, the lamp tube includes a first end section, a body section, and a second end section, wherein the second region is larger at the first end section and at the second end section than at the body section of the lamp tube.

The features of the present invention are described as follow. The diffusion film disposed on the surface of the lamp tube includes a first region and a second region. Light emitted from the LED substrate passes through the second region and then falls on an illuminated region. The first region is arranged in the backside of the LED tube lamp (relative to the light emergent region). The first region can partially or entirely block out light emitted from the LED substrate toward the first region. As such, the light emitted toward the first region is at least partially unable to pass through the first region. Moreover, the light emitted toward the first region is reflected back toward the second region and then passing through the second region to the illuminated region. By the arrangement of the first region, the present invention narrows the beam angle of a LED tube lamp and improves the lighting efficiency.

DETAILED DESCRIPTION

Figure 1:
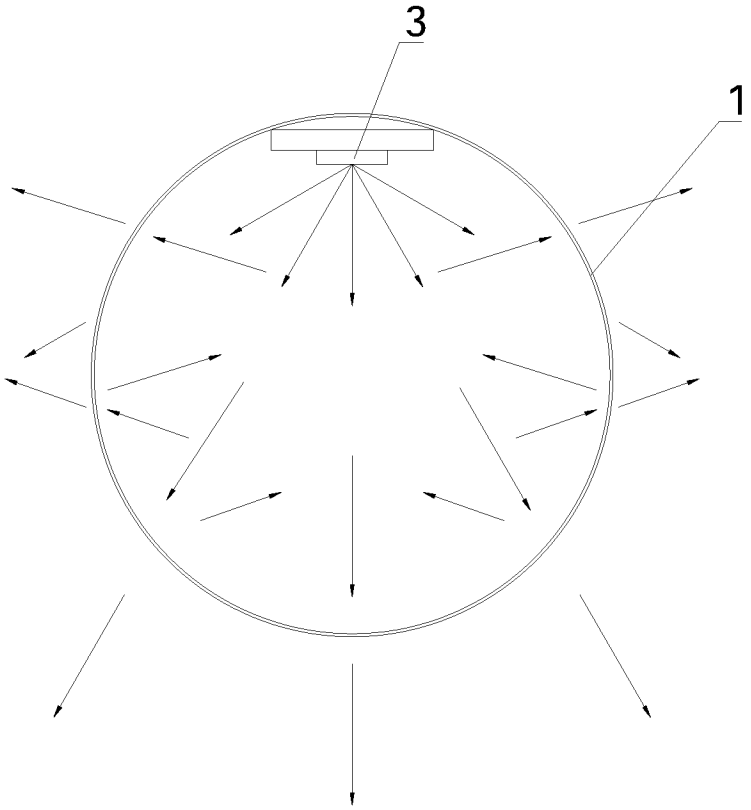
FIG. 1 illustrates a schematic diagram of light path of a conventional LED tube lamp.

The beam angle of a conventional LED tube lamp is about 220 degrees. As shown in FIG. 1, the beam angle of the LED tube lamp is large, so a portion of the light beam would pass through the lamp tube toward the backside of the light source. As a result, some emitted light beam would not be able to reach the object to be lit, which is a waste of the emitted light beam. The light utilization is inefficient.

The detailed description of the technical contents, the purposes and the efficacy of the present invention is provided below with several embodiments, in accordance with the accompanying drawings. The present invention discloses a lamp tube with a diffusion film including a first region and a second region. The beam angle of the tube lamp is limited, and the efficiency of light utilization is improved.

Figure 2:
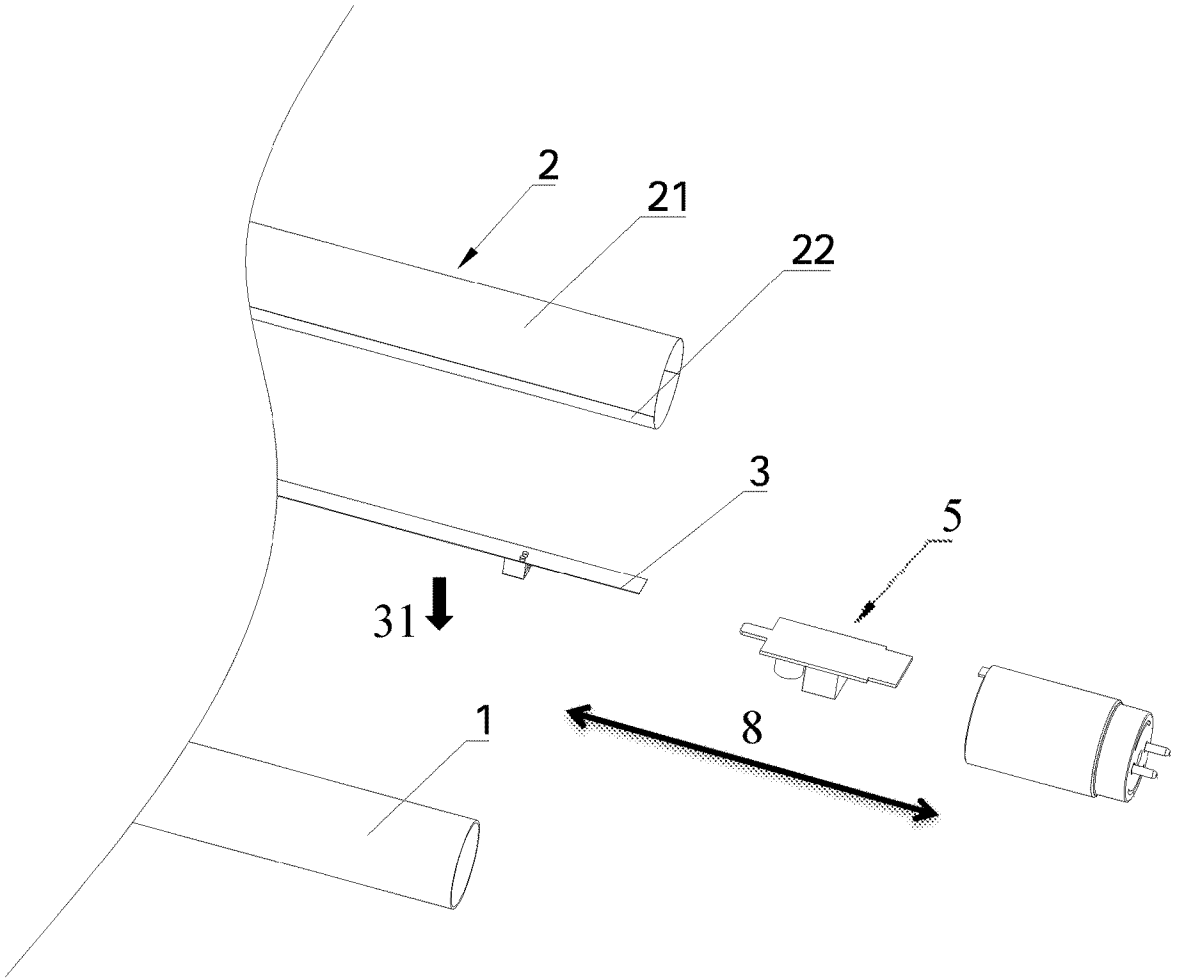
FIG. 2 illustrates an exploded view of a LED tube lamp according to one embodiment of the present invention.
Figure 3:
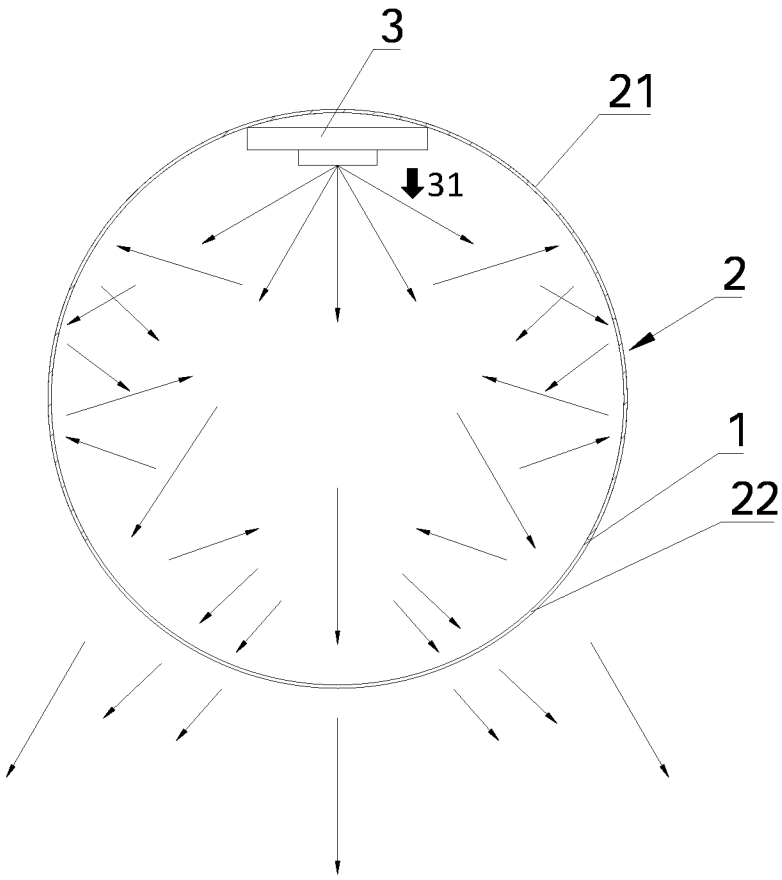
FIG. 3 illustrates a schematic diagram of light path of a LED tube lamp according to the embodiment of the present invention.

Refer to FIG. 2 and FIG. 3. In one embodiment, the LED tube lamp includes a lamp tube 1, an LED substrate 3, and a diffusion film 2. The LED substrate 3 is disposed inside the lamp tube 1. The LED substrate 3 includes a plurality of LED chips (not shown) disposed on a forward side 31 of the LED substrate 3 for emitting light, and a driving circuitry 5 for receiving power to enable the plurality of LED chips. The diffusion film 2 is configured for being disposed on a surface of the lamp tube 1. The diffusion film 2 includes a first region 21 and a second region 22 adjacent to the first region. The first region 21 and the second region 22 of the diffusion film 2 are arranged along a longitudinal axis 8 of the lamp tube 1. As shown in FIG. 3, the first region 21 is located proximal to the LED substrate 3, and the second region 22 is located distal to the LED substrate. The first region 21 has a first transmittance rate and the second region 22 has a second transmittance rate higher than the first transmission rate.

In some embodiments, the first region 21 of the diffusion film 2 is capable of reflecting a significant portion of light emitted from the plurality of LED chips toward the second region 22 of the diffusion film. With such arrangement, the first region 21 can partially or entirely block out light emitted from the plurality of LED chips toward the first region 21; some or all of the emitted light toward the first region 21 is unable to pass through the first region 21. Moreover, some or all of the emitted light toward the first region 21 is reflected back to the second region 22 and then passing through the second region 22 to the illuminated region. With such arrangement, the beam angle of the tube lamp is limited to an angle provided by the second region 22 corresponding to the lamp tube. The efficiency of light utilization is improved.

In some embodiments, the second region 22 includes transparent or translucent material mixed with light diffusion particles. The second region 22 may be formed by coating transparent or translucent materials mixed with light diffusion particles onto the lamp tube 1.

The first region 21 and the second region 22 of the diffusion film 2 may be formed by coating particles onto the lamp tube 1, such that the first region 21 has a first transmittance rate and the second region 22 has a second transmittance rate higher than the first transmission rate. The coated particles may be different on the first region 21 and the second region 22. The coated particles may be the same but with different densities on the first region 21 and the second region 22.

In some embodiments, the second region 22 is formed by coating a transparent or translucent material on the surface of the lamp tube 1.

In some embodiments, the second region 22 includes a plurality of light diffusion particles coated on the surface of the lamp tube 1.

Further, to improve heat dissipation, high thermal conductivity particles may also be used in the diffusion film 2. In some embodiments, high thermal conductivity particles are added to the diffusion film, so the first region 21 of the diffusion film 2 has a higher thermal conductivity than the second region of the diffusion film.

In some embodiments, the diffusion film 2 is formed by coating a plurality of first particles on the first region, and a plurality of second particles different from the first particles on the second region.

In some embodiments, the first region 21 of the diffusion film 2 is disposed proximal to the forward side 31 of the LED substrate 3, and the second region 22 of the diffusion film is disposed distal to the forward side 31 of the LED substrate 3.

In some embodiments, the first region 21 may be formed by coating a plurality of light reflection particles on the surface of the lamp tube 1.

Figure 4:
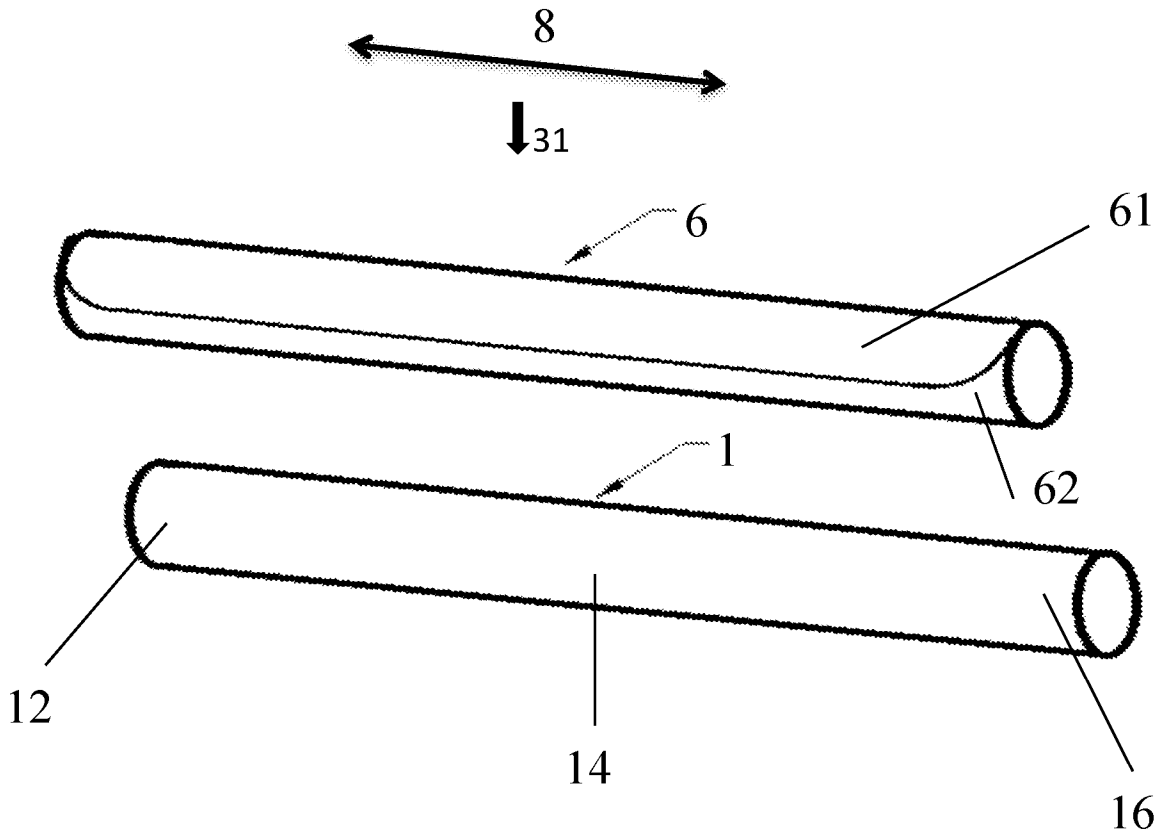
FIG. 4 illustrates another embodiment of the diffusion film.

Due to the shape of the lamp tube 1, the light generated by the LED tube lamp may be less bright near the end sections of the lamp tube 1. To improve light emitting characteristics, the second region 22 of the diffusion film 2 may be larger near the end sections of the lamp tube 1. FIG. 4 shows another example of the diffusion film. In this embodiment, the lamp tube 1 has a first end section 12, a body section 14, and a second end section 16. The diffusion film 6 has a first region 61 and a second region 62 adjacent to the first region 61. Both the first region 61 and the second region 62 are arranged along a longitudinal axis 8 of the lamp tube 1. The first region 61 of the diffusion film 6 is disposed proximal to the forward side 31 of the LED substrate 3, and the second region 62 of the diffusion film 6 is disposed distal to the forward side 31 of the LED substrate 3. Particularly, the second region 62 is larger near the first end section 12 and the second end section 16 than at the body section 14 of the lamp tube 1 so as to improve the light emitting characteristics of the LED tube lamp.

In some embodiments, to improve light emitting characteristics, the first region 61 includes light reflecting particles. The light reflecting particles may be coated onto the lamp tube 1, and the light reflecting particles has a higher density at the first end section 12 and the second end section 16 than at the body section 14.

In some embodiments, to improve light emitting characteristics, the first region 62 includes light diffusion particles. The light diffusion particles may be coated onto the lamp tube 1, and the light diffusion particles has a higher density at the first end section 12 and the second end section 16 than at the body section 14.

In another embodiment, the diffusion film may also be integrated with the lamp tube. For example, the diffusion film may be integrally formed on the inner surface or outer surface of the lamp tube 1. Similar to the above embodiments, the diffusion film includes a first region and a second region. Particularly, the first region includes a plurality of first optical lenses integrally formed on the surface of the lamp tube, and the second region includes a plurality of second optical lenses integrally formed on the surface of the lamp tube. The first optical lenses are configured to reflect of lights emitted from the LED chips toward the second region. The second optical lenses are configured to focus and diffuse the lights emitted from the LED chips and the lights reflected by the first optical lenses. With such arrangement, the LED tube lamp may improve its lighting characteristics and achieve the objective of this invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

We claimed:

1. A LED tube lamp, comprising:

a lamp tube comprising a first end section, a body section and a second end section, the first end section and the second end section being located at two opposite ends along a longitudinal axis of the lamp tube, the body section being between the first end section and the second end section;

an LED substrate disposed inside the lamp tube, the LED substrate includes a plurality of LED chips disposed on a forward side of the LED substrate for emitting light;

a driving circuitry for receiving power to enable the plurality of LED chips; and a diffusion film covering all surface of the lamp tube, the diffusion film is consisted of a first region and a second region adjacent to the first region, the first region and the second region are arranged along the longitudinal axis of the lamp tube, the first region covering a first portion of the first end section, a body section and a second end section, the second region covering a second portion of the first end section, a body section and a second end section, the first region has one same first transmittance rate over the first region and the second region has one same second transmittance rate over the second region higher than the first transmission rate.

2. The LED tube lamp of claim 1, wherein the first region of the diffusion film is capable of reflecting a significant portion of lights emitted from the plurality of LED chips toward the second region of the diffusion film.

3. The LED tube lamp of claim 2, wherein the first region of the diffusion film has a higher thermal conductivity than the second region of the diffusion film.

4. The LED tube lamp of claim 1, wherein the diffusion film is formed by coating a plurality of first particles on the first region, and a plurality of second particles different from the first particles on the second region.

5. The LED tube lamp of claim 1, wherein the first region of the diffusion film is disposed proximal to the forward side of the LED substrate, and the second region of the diffusion film is disposed distal to the forward side of the LED substrate.

6. The LED tube lamp of claim 1, wherein the first region of the diffusion film has a higher thermal conductivity than the second region of the diffusion film.

7. The LED tube lamp of claim 1, wherein the first region includes a plurality of light reflection particles coated on the surface of the lamp tube.

8. The LED tube lamp of claim 7, wherein the light reflecting particles has a higher density at the first end section and the second end section than at the body section.

9. The LED tube lamp of claim 1, wherein the first region includes a plurality of high thermal conductivity particles coated on the surface of the lamp tube.

10. The LED tube lamp of claim 1, wherein the second region includes transparent or translucent material mixed with light diffusion particles.

11. The LED tube lamp of claim 1, wherein the second region is formed by coating a transparent or translucent material on the surface of the lamp tube.

12. The LED tube lamp of claim 1, wherein the second region includes a plurality of light diffusion particles coated on the surface of the lamp tube.

13. The LED tube lamp of claim 12, wherein the light diffusion particles have a higher density at the first end section and the second end section than at the body section.

14. The LED tube lamp of claim 1, wherein the second region of the diffusion film is larger at the first end section and at the second end section than at the body section.

* * * * *